US005924960A

United States Patent [19]

Cohen

[11] Patent Number: 5,924,960

[45] Date of Patent: Jul. 20, 1999

[54] AMBULATION AND MOBILITY APPARATUS FOR THERAPEUTIC EXERCISE

[75] Inventor: Charles Cohen, Fair Lawn, N.J.

[73] Assignee: Hausmann Industries, Inc., Northvale, N.J.

[21] Appl. No.: 08/946,083

[22] Filed: Oct. 7, 1997

[51] Int. Cl.[6] ..... A63B 23/04

[52] U.S. Cl. ..... 482/51; 434/255; 482/35; 482/42

[58] Field of Search ..... 482/23, 35, 38, 482/40, 41, 42, 51; 434/258, 255

[56] References Cited

U.S. PATENT DOCUMENTS

| | | | |
|---|---|---|---|
| 2,690,789 | 10/1954 | Zadrozny | 482/51 |
| 3,747,233 | 7/1973 | Berryman | 434/255 |
| 4,549,732 | 10/1985 | Hoffman | 482/51 |
| 4,580,777 | 4/1986 | Johnson | 482/38 |
| 4,988,092 | 1/1991 | Trout | 482/51 |
| 5,052,682 | 10/1991 | Croce, Jr. et al. | 482/51 |
| 5,076,571 | 12/1991 | Croce, Jr. et al. | 482/51 |
| 5,096,188 | 3/1992 | Shen | 482/51 |

*Primary Examiner*—Jerome Donnelly
*Assistant Examiner*—Victor K. Hwang
*Attorney, Agent, or Firm*—Jay H. Maioli

[57] ABSTRACT

A therapeutic exercise apparatus for providing ambulation and mobility physical therapy includes a flat platform and two parallel handrails with ladder steps arranged on the platform at the place where the patient would place their feet, so that the gait of the patient is controlled and increased movement of the patient's feet is required in order to permit the patient to traverse the length of the platform. A balance beam extending along the length of the platform can be placed on the platform in lieu of the ladder steps. The steps are removably attached to the platform by means of dowel pins fitting in corresponding holes bored in the surface of the platform.

10 Claims, 2 Drawing Sheets

AMBULATION AND MOBILITY APPARATUS FOR THERAPEUTIC EXERCISE

BACKGROUND OF THE INVENTION

1. Field of the Invention

This invention relates generally apparatus for use in physical therapy and, more particularly, to apparatus for use in ambulation therapy.

2. Description of Background

The field of physical therapy has been getting more and more attention upon the recognition that recuperation and recovery from surgery and accidents can be implemented by the patient performing various exercises and the like. For example, walking is found to help many recovering patients and disabled persons. Nevertheless, in many cases the patient could not simply walk on their own. Therefore, there have been known some systems having handrails that resemble the parallel bars in gymnastic equipment and that permit the patient to hold on with their hands and arms to the handrails as they walk along. In such previously proposed systems, the handrails or parallel bars are provided with uprights or standards similar to those of the gymnastic equipment that are simply placed on the floor of the physical therapy training area.

OBJECTS AND SUMMARY OF THE INVENTION

Accordingly, it is an object of the present invention to provide an improved apparatus that can increase the effectiveness of the previously known ambulatory therapy device by requiring more complicated movements of the patient's feet, while still providing handrail support.

Another object of this invention is to provide improved ambulation and mobility platform mounted parallel bars with ladder steps or risers on the platform, so that the patient is required to lift his or her feet during the ambulation therapy.

A further object of this invention is to provide improved ambulation and mobility platform mounted parallel bars in which a balance beam is provided, so that the patient can walk the length of the balance beam while being supported by the parallel bars.

In accordance with an aspect of the present invention a platform is provided that has mounted thereon parallel bars that are adjustable in both height and spacing and in which the platform has ladder steps attached thereto at selected locations, so that when the patient performs the ambulation therapy the patient must step up and over each of the ladder step thereby improving the amount of motion required for the patient to traverse the length of the platform.

In another aspect of the present invention, a platform with mounted parallel bars is provided with a balance beam that runs the length of the platform at substantially the middle, of so that the patient may walk the length of the balance beam while being steadied by the parallel bars.

The above and other objects, features, and advantages of the present invention will become apparent from the following detailed description of the illustrative embodiments thereof to be read in conjunction with the accompanying drawings.

DETAILED DESCRIPTION OF PREFERRED EMBODIMENTS

Figures 1, 2:
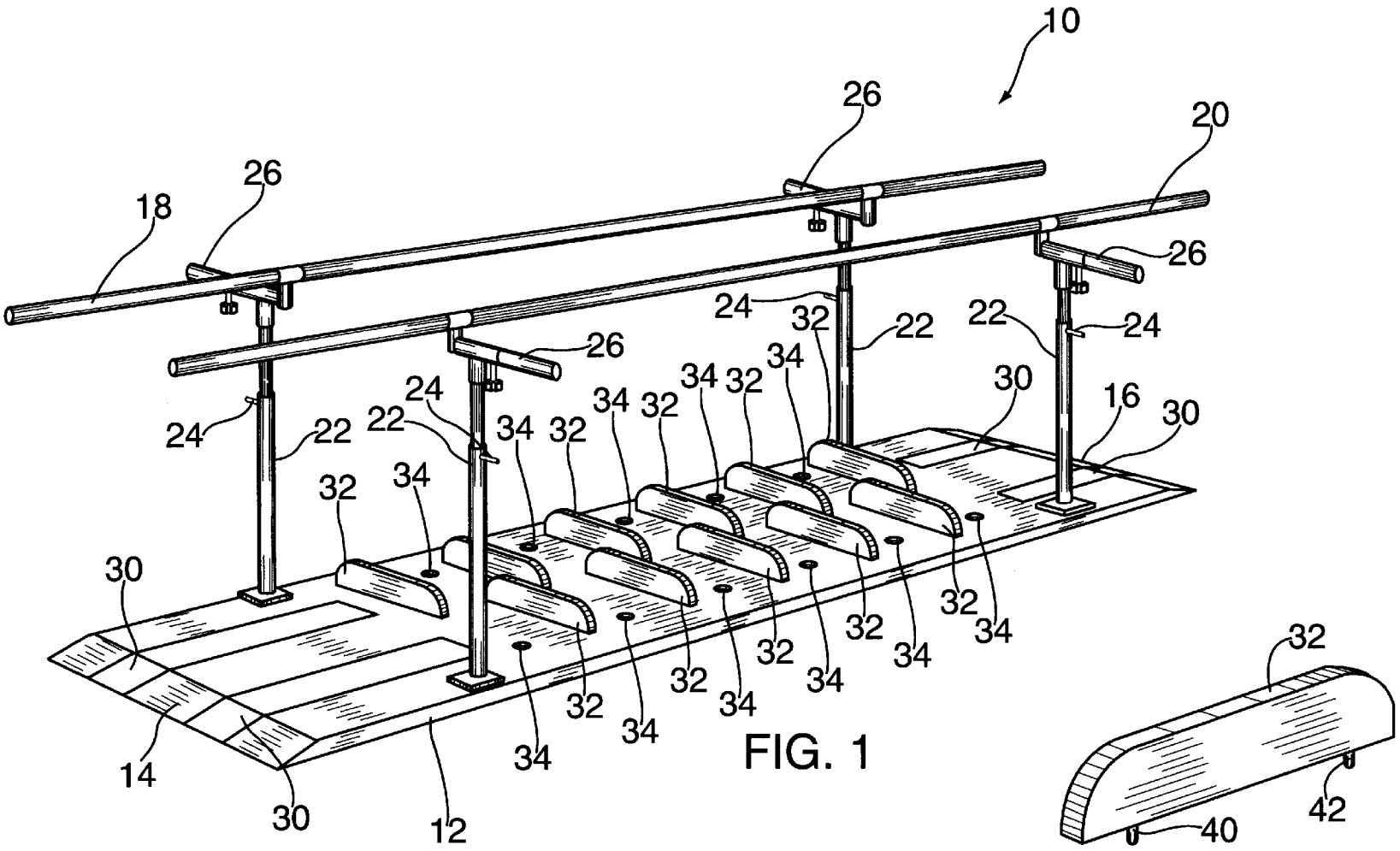
FIG. 1 is a perspective view of an ambulation and mobility platform having parallel bars mounted thereon according to an embodiment of the present invention.
FIG. 2 is a perspective view of a ladder step used in the embodiment of FIG. 1.

FIG. 1 is a perspective view of the ambulation and mobility platform with mounted parallel bars 10, in which a wooden platform 12 is provided with tapered ends 14 and 16, the function of which will be described below. The platform 12 can be any desired length, for example, ten feet might be a useful length that is, not too ponderous. Mounted on the platform 12 are a pair of parallel bars 18, 20 that act as handrails for the patient, and the parallel bars 18, 20 are mounted using two pairs of uprights shown typically at 22. Each of the uprights 22 is adjustable vertically and is provided with variable height adjustments by using locking pins, shown typically at 24, that cooperate with holes formed in the two telescoping pipes that are used to form each of the variable height handrail uprights 22. Thus, by reason of the two telescopic tubes forming the variable height adjustable uprights 22 and the locking pins 24, the handrails 18 and 20 can be adjusted to any practical height for supporting and guiding the patient as he or she traverses the length of the platform 12. For example, the handrails 18, 12 can be adjusted from 29 inches to 42 inches in height.

The distance between the handrails 18 and 20 is also fully adjustable by reason of variable width adjustment brackets, shown typically at 26. These brackets are formed of right-angle tubes attached to each handrail that cooperate with respective sleeves at the top of the standards 22. An ergonomic locking knob 28 permits the bracket to slide inwardly and outwardly relative to the handrail uprights 22. By operating the adjusting brackets 26, the width between the handrails 18, 20 may be varied anywhere from approximately 15 inches to 28 inches.

Thus, it is seen that the platform 12 is provided with handrails 18, 20 for use by the patient so that the patient may walk the length of the platform, regardless of the height of the patient and regardless of the extent of motion available to the arms of the patient. This is made possible by providing the variable height adjusting uprights 22, as well as the variable width adjustments to the handrails 18, 20.

In regard to the tapered ends 14, 16 of the platform 12, these are provided so that a patient in a wheelchair can easily place the wheelchair in position between the ends of the handrails 18, 20 and to facilitate such positioning two anti-slip rubber treads, shown typically at 30, are provided at each of the platform. Thus, the individual undergoing physical therapy and employing the ambulation and mobility platform with the mounted parallel bars 10, as shown in FIG. 1, can be placed in the exercise position quite readily.

Now, as noted hereinabove, it is important to have the patient perform a more complicated physical movement than simply shuffling the feet along the length of the platform. As might be imagined, when mobility is restricted in the lower extremities of a patient, the patient tends to not utilize those lower extremities if at all possible, which means that the patient could actually traverse the length of the platform 12 by dragging themselves along by their arms using the handrails 18, 20. To prevent such an occurrence and to provide a more complicated motion to the person undergoing therapy, the present invention provides a plurality of ladder steps or risers, shown typically at 32, which require the patient to lift their feet and to have a certain step length in order to walk the length of the platform 12. In this embodiment there are eleven ladder steps 32, however, this number may vary. Each ladder step can be approximately fifteen inches long and two inches in height. These ladder steps 32 are perpendicular to the length of the platform 12, as shown in FIG. 1, however, they might also be arranged to be parallel to the length of the platform as well.

The ladder steps 32 are vertically perpendicular to the flat surface of the platform 12 and are attached thereto by dowels, not shown in FIG. 1, that fit into holes bored at selected intervals in the platform 12. Several of these holes 34 are seen in FIG. 1 and it is to be understood that similar holes are arranged beneath each of the ladder steps 32. Although only a few unoccupied holes are shown in FIG. 1, it is to be understood that any number of such holes could be arranged in the three rows along the length of the platform 12, so that the actual placement of the ladder steps is completely variable. This has the effect of controlling the intervals between the successive ladder steps 32 and, thus, performing the so-called physical therapy operation of gait training. This gives the therapist flexibility in working with the patient.

An individual ladder step 32 is shown in FIG. 2, wherein it is seen that two dowel pins 40 and 42 are provided for each of the ladder steps for subsequently arranging into the holes 34 arranged in the three rows and bored in the platform 12.

Figure 3:
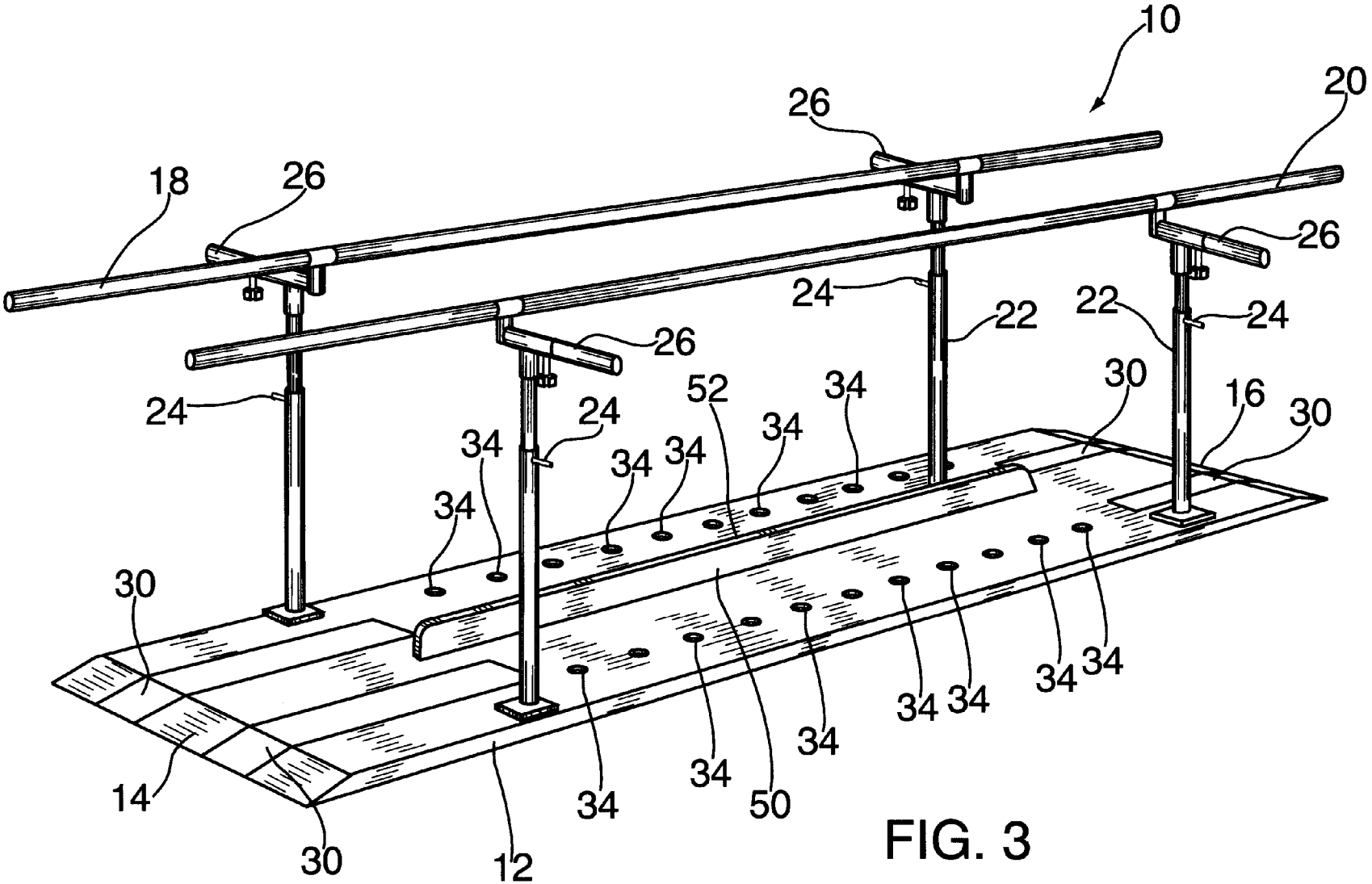
FIG. 3 is a perspective view of an ambulation and mobility platform having parallel bars mounted thereon according to a second embodiment of the present invention.

Referring to FIG. 3, a second embodiment of the present invention is disclosed in which in place of the ladder steps 32 a balance beam 50 is provided that is arranged to run down the middle of the longitudinal length of the platform 12. The balance beam 50 can be around six or seven feet long, three inches high, and approximately six inches wide. The balance beam 50 is attached to the platform 12 in the same manner as the ladder steps 32 in the embodiment of FIG. 1, that is, by means of dowel pins, not shown, being arranged into corresponding holes bored in the platform 12. The dowel pins of the balance beam 50 can, indeed, fit into the same holes used to mount the ladder steps 32, and in that regard the remaining holes 34 not used in the embodiment of FIG. 3 are clearly seen in FIG. 3. On an upper surface of the balance beam 50 is provided a rubber tread 52 so that the patient may actually walk along the length of the balance beam on the rubber surface 52 to improve their balance and coordination as part of their physical training. The balance beam 50 can be formed generally like the ladder step 32 of FIG. 2 with one or more dowel pins for mounting, except that the balance beam 50 is wider and much longer, of course.

It should be understood that the above description is presented by way of example only and that various adaptations and modification of the present invention may be made without departing from the spirit and scope of the invention, which should be determined solely by the up ended claims.

What is claimed is:

1. A therapeutic exercise apparatus consisting essentially of:

a platform in the form of an elongate rectangle;

two pair of uprights arranged along longer sides of said elongate rectangle and mounted on said platform;

a pair of parallel handrails each attached to free ends of a respective one of said two pair of uprights and extending along a longitudinal length of said platform; and a plurality of interchangeable risers all readily removably affixed so as to be repositioned to a flat upper surface of said platform in the same horizontal plane and extending substantially perpendicularly thereto toward said pair of parallel handrails, said plurality of risers being arranged mutually spaced apart in two rows on said upper surface of said platform.

2. The therapeutic exercise apparatus of claim 1, wherein each of said plurality of risers includes a plurality of mounting pins for placement into a corresponding plurality of holes formed in said upper surface of said platform for use in repositioning said plurality of risers.

3. The therapeutic exercise apparatus of claim 2, wherein said plurality of holes formed in said upper surface of said platform are arranged in three rows along the length of said platform.

4. The therapeutic exercise apparatus of claim 1, wherein said plurality of risers are arranged in said two rows along the length of said platform and are arranged such that risers in a first row are alternately staggered with respect to risers in a second row.

5. The therapeutic exercise apparatus of claim 4, wherein said plurality of risers include eleven risers.

6. The therapeutic exercise apparatus according to claim 1, wherein each of said plurality of risers extend substantially two inches above the flat surface of said platform.

7. The therapeutic exercise apparatus according of claim 1, wherein said two pair of uprights comprise means for adjusting a width dimension between said pair of parallel handrails.

8. The therapeutic exercise apparatus of claim 1, wherein said two pair of uprights comprise means for adjusting a height of said free ends thereof above the flat surface of said platform.

9. The therapeutic exercise apparatus of claim 1, wherein at least one end of said platform is tapered.

10. A therapeutic exercise apparatus comprising:

a platform in the form of an elongate rectangle having a flat upper surface;

two pair of uprights arranged along longer sides of said elongate rectangle and mounted on said flat surface of said platform;

a pair of parallel handrails each attached to free ends of respective one of said two pair of uprights and extending along a length of said platform; and a plurality of ladder steps each having a plurality of mounting pins for being removably affixed to a flat upper surface of said platform, said plurality of ladder steps being arranged in two rows along the length of said platform and being mutually longitudinally spaced apart such that ladder steps in a first row are alternately staggered with respective to ladders steps in a second row.

* * * * *